US007374315B2

(12) United States Patent
Dorsey et al.

(10) Patent No.: US 7,374,315 B2
(45) Date of Patent: May 20, 2008

(54) LIGHTING DEVICE

(76) Inventors: Joshua Dorsey, 4123 De Maisonneuve Blvd. West, Montreal, Quebec (CA) H3Z 1K2; Talia Dorsey, 444 Franklin St., Cambridge, MA (US) 02139; Mathew Laibowitz, 444 Franklin St., Cambridge, MA (US) 02139

( * ) Notice: Subject to any disclaimer, the term of this patent is extended or adjusted under 35 U.S.C. 154(b) by 165 days.

(21) Appl. No.: 10/966,894

(22) Filed: Oct. 15, 2004

(65) Prior Publication Data

US 2006/0082987 A1 Apr. 20, 2006

Related U.S. Application Data

(60) Provisional application No. 60/610,703, filed on Sep. 17, 2004.

(51) Int. Cl.
*F21V 21/08* (2006.01)

(52) U.S. Cl. ..... 362/294; 362/249; 362/800

(58) Field of Classification Search ..... 362/800, 362/108, 103, 104, 105, 106, 249
See application file for complete search history.

(56) References Cited

U.S. PATENT DOCUMENTS 4,727,603 A * 3/1988 Howard ..... 2/115
4,729,076 A * 3/1988 Masami et al. ..... 362/235
4,823,240 A * 4/1989 Shenker ..... 362/103
5,019,438 A * 5/1991 Rapisarda ..... 428/102
5,025,351 A * 6/1991 Martin ..... 362/506
5,111,366 A * 5/1992 Rife et al. ..... 362/605
5,531,601 A * 7/1996 Amoroso ..... 439/37
5,575,098 A * 11/1996 Goettel-Schwartz ..... 40/550
5,882,110 A * 3/1999 Rapisarda ..... 362/570
5,934,792 A 8/1999 Camarota
6,007,211 A * 12/1999 Cheung ..... 362/103
6,168,286 B1 * 1/2001 Duffy ..... 362/106
6,174,075 B1 1/2001 Fuwausa
6,193,385 B1 * 2/2001 Maki et al. ..... 362/108
6,311,350 B1 * 11/2001 Kaiserman et al. ..... 5/639
6,402,336 B1 6/2002 Reese
6,481,877 B1 11/2002 Bello, Jr.
6,517,214 B1 * 2/2003 Mitchell et al. ..... 362/108
6,679,615 B2 * 1/2004 Spearing ..... 362/103
6,935,761 B2 * 8/2005 Vanderschuit ..... 362/106
6,969,178 B2 * 11/2005 Zuloff ..... 362/106
2001/0030866 A1 * 10/2001 Hochstein ..... 362/294
2003/0156426 A1 8/2003 Givoletti
2005/0237741 A1 * 10/2005 Chang ..... 362/249
2006/0007059 A1 * 1/2006 Bell ..... 345/55

* cited by examiner

*Primary Examiner*—Anabel M Ton
(74) *Attorney, Agent, or Firm*—Husch Blackwell Sanders LLP

(57) ABSTRACT

The present invention provides a lighting device that comprises at least one light emitting diode that is adapted for being electrically connected to a power source, and at least one sheet of fabric for covering the at least one light emitting diode. As such, light emitted from the at least one light emitting diode is able to shine through the at least one sheet of fabric.

45 Claims, 9 Drawing Sheets

LIGHTING DEVICE

APPLICATION CROSS-REFERENCE

This application claims priority from U.S. provisional application Ser. No. 60/610,703, entitled "High Brightness LED embedded Illuminating Fabric" filed on Sep. 17, 2004, the contents of which are incorporated herein by reference.

FIELD OF THE INVENTION

The present invention relates to the field of lighting devices, and more specifically, to lighting devices that comprise light emitting diodes (LEDs) covered by fabric.

BACKGROUND OF THE INVENTION

Lighting devices, such as overhead lighting fixtures and lamps are known in the art. These traditional types of lighting devices often use filament-type light bulbs as their illumination source, which are known to have numerous disadvantages. For example, filament-type light bulbs emit heat, have a relatively short life span, and are energy inefficient in comparison to alternative lighting sources that have become available over recent years. For example, illumination sources such as halogen lights, neon lights, fluorescent lights and light emitting diodes (LEDs) have increased in popularity as illumination sources over recent years, and are known to be more energy efficient and have longer life spans than filament light bulbs.

With all the advantages associated with these alternative illumination sources, the lighting industry has begun to use them for various applications. For example, LEDs are commonly used for automotive indicator lights, street lights, etc. . . . In addition to these uses, there is a recent movement towards using LED lights in order to retro-fit existing types of lighting devices, such as overhead lighting fixtures and existing types of lamps. Although retrofitting existing lighting fixtures with LEDs creates more energy efficient lighting devices, they create the overall same lighting effect as existing lighting devices. As such, it does not appear that the lighting industry is moving towards using LEDs to create new types of lighting devices that have characteristics that differ from existing lighting devices.

As such, there is a need in the industry for non-traditional lighting devices that use LEDs in order to create more versatile lighting devices that display characteristics such as flexibility and softness that are lacking in the art.

SUMMARY OF THE INVENTION

In accordance with a first broad aspect, the present invention provides a lighting device that comprises at least one light emitting diode that is adapted for being electrically connected to a power source, and at least one sheet of fabric for covering the at least one light emitting diode. As such, light emitted from the at least one light emitting diode is able to shine through the at least one sheet of fabric.

In accordance with a second broad aspect, the present invention provides a lighting device that comprises a first sheet of fabric, a second sheet of fabric connected to the first sheet of fabric, a plurality of light emitting diodes and at least one heat sink. The plurality of light emitting diodes are positioned between the first sheet of fabric and the second sheet of fabric and are electrically connected to a power source. The one or more heat sinks are in thermally conductive communication with at least one of the plurality of light emitting diodes.

In accordance with another broad aspect, the present invention provides an illumination device that comprises a plurality of light emitting diodes that are electrically connected to a power source, a sheet of fabric covering the plurality of light emitting diodes and a mounting structure adapted for being mounted to a supporting structure. The mounting structure is adapted for mounting the plurality of light emitting diodes and the sheet of fabric to the mounting structure.

These and other aspects and features of the present invention will now become apparent to those of ordinary skill in the art upon review of the following description of specific embodiments of the invention and the accompanying drawings.

Other aspects and features of the present invention will become apparent to those ordinarily skilled in the art upon review of the following description of specific embodiments of the invention in conjunction with the accompanying figures.

DETAILED DESCRIPTION

The present invention will be described below with reference to FIGS. 1 through 8, wherein like numerals are used to refer to like and corresponding parts of the various drawings.

Figure 1:
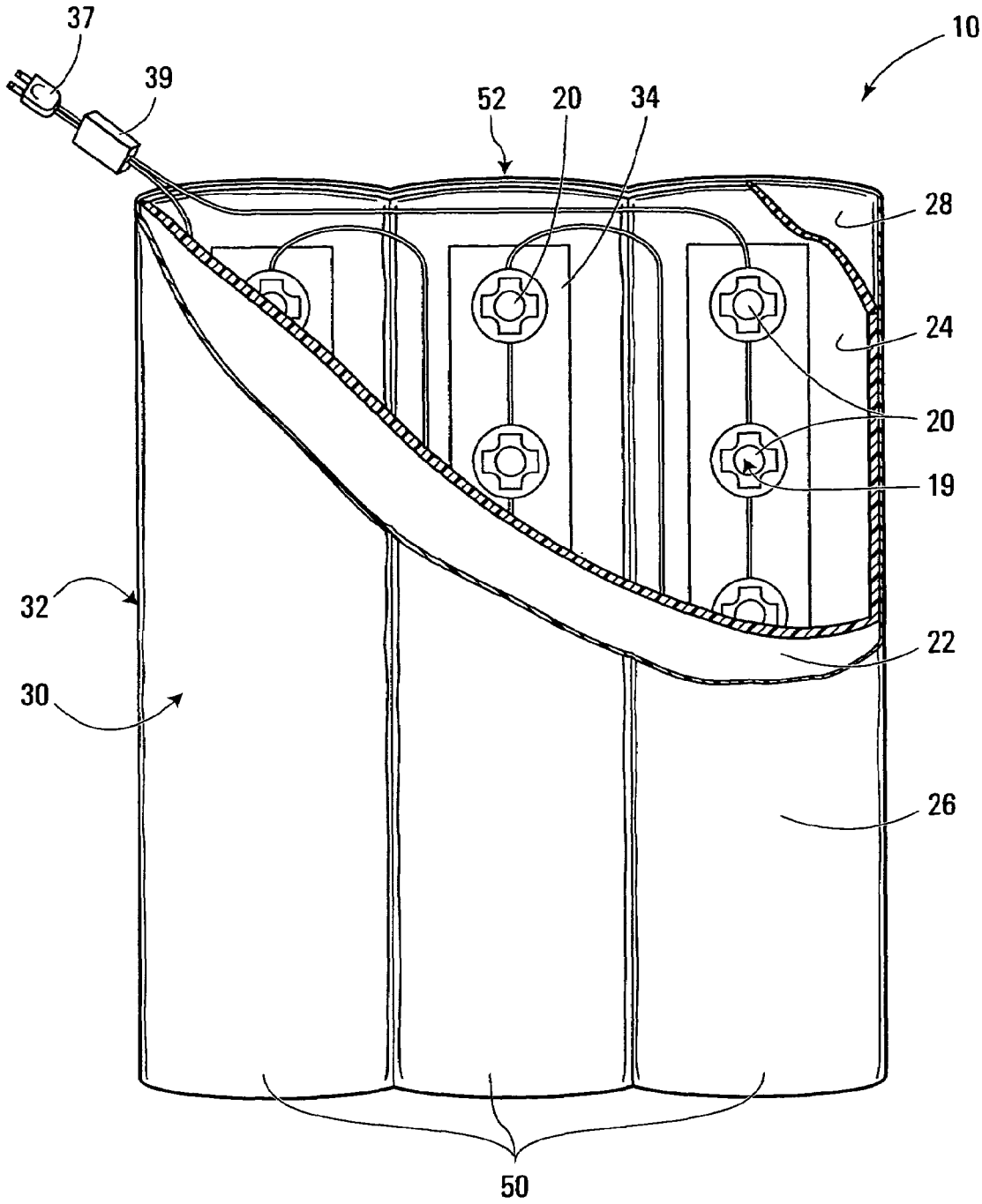
FIG. 1 shows a front plan view of a lighting device in accordance with a non-limiting embodiment of the present invention.

Shown in FIG. 1 is a lighting device 10 in accordance with a non-limiting embodiment of the present invention. The lighting device 10 includes a first sheet of fabric 22, a second sheet of fabric 24, an outer finishing sheet of fabric 26, a backing sheet of fabric 28 and a plurality of spaced-apart light emitting diodes (LEDs) 20 positioned between the first sheet of fabric 22 and the second sheet of fabric 24. When the LEDs 20 are activated, the light emitted by the LEDs 20 shines through at least the first sheet of fabric 22 and the finishing sheet of fabric 26 so as to illuminate a surrounding area. For the purposes of clarity, a portion of the first sheet of fabric 22, the second sheet of fabric 24 and the finishing sheet of fabric 26 have been cut away. It will be appreciated that for the purposes of the present invention, the term "fabric" refers to either woven or non-woven flexible materials.

Figure 2:
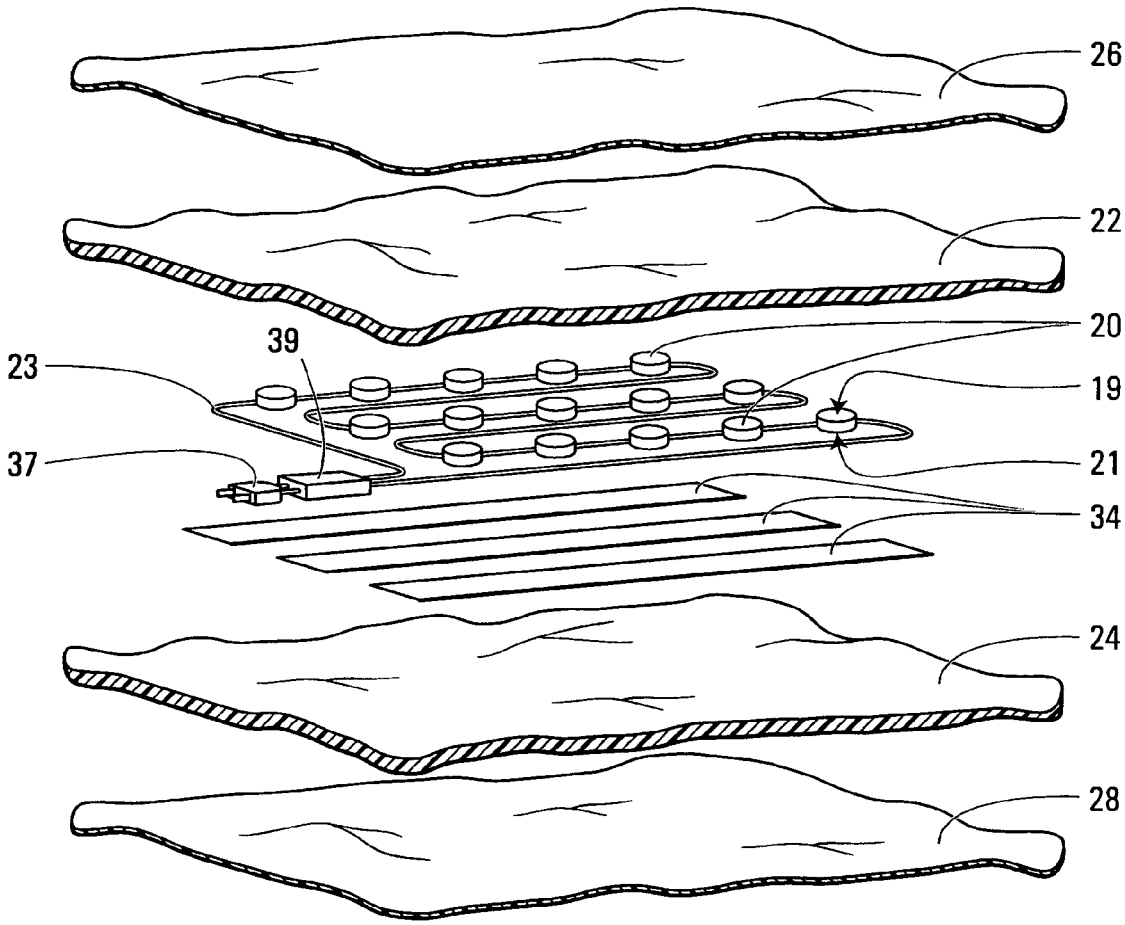
FIG. 2 shows an exploded view of the lighting device of FIG. 1.

As shown in FIG. 2, each of the light emitting diodes 20 includes a light emitting portion 19 and a backing portion 21. In the embodiment shown in FIG. 1 the LEDs 20 are positioned such that their light emitting portions 19 are facing towards the first sheet of fabric 22. In this manner, when the LEDs 20 are activated, the light emitted from the LEDs 20 shines through the first sheet of fabric 22 and through the outer finishing sheet of fabric 26 such that light is emitted from the front surface 30 of the lighting device 10. It should be understood that although the light emitting portions 19 of the LEDs 20 face the first sheet of fabric 22, some of the light emitted from the LEDs 20 also shines through the second sheet of fabric 24 and the backing sheet of fabric 28. As such, light will also be emitted from the rear surface 32 of the lighting device 10 as well.

In an alternative example of implementation, the orientation of the light emitting portions 19 of the LEDs can be varied. For example, the LEDs 20 can be positioned such that the light emitting portions 19 of half the LEDs 20 are facing towards the first sheet of fabric 22, and the light emitting portions 19 of the other half of the LEDs 20 are facing towards the second sheet of fabric 24. For example, the LEDs 20 may be positioned back to back.

The different sheets of fabric of the lighting device 10 will now be described in more detail with reference to FIG. 2, which shows an exploded view of the lighting device 10. As shown in FIG. 2, the first sheet of fabric 22 covers the light emitting portions 19 of the LEDs 20. It should be appreciated that the first sheet of fabric 22 can be formed of any woven or non-woven material known in the art, without departing from the spirit of the invention. However, in a non-limiting embodiment, the first sheet of fabric 22 is formed of a fibrous material, such as batting, which provides good diffusion of the light emitted from the light emitting diodes 20. As such, the batting helps to spread the light emitted from the LEDs.

Positioned on top of the first sheet of fabric 22 is a finishing sheet of fabric 26. The finishing sheet of fabric 26 may be used in combination with the first sheet of fabric 22 in order to provide different aesthetic looks to the lighting device 10, and to create different aesthetic effects to the quality of illumination given off by the lighting device 10. For example, the finishing material can be textured, patterned or colored. Some non-limiting examples of finishing materials include non-woven, woven, netted and silk fabrics.

It will be appreciated by a person skilled in the art that depending on the materials used to cover the LEDs 20, different lighting effects can be achieved. For example, different materials can affect the degree of diffusion of the light, as well as the color, pattern and direction of the light. For example, colored materials may cause the light emitted from the lighting device to take on the color of that material, and for patterned materials, the light emitted from the LEDs 20 may cause the pattern on the material to be illuminated. In addition, the use of a material that doesn't diffuse light very well will cause the lighting device 10 to provide a much more focused light than a material that provides good diffusion of the light. As such, the type of material selected for the first sheet of fabric 22 and the finishing sheet of fabric 26 will depend greatly on the type of illumination desired from the lighting device 10.

It should also be appreciated that the selection of materials can affect the performance of the lighting device 10. For example, the materials selected for the lighting device may provide durability, water resistance, flame resistance, insulation and acoustic performance to the lighting device 10. In addition, it should be understood that fabrics having good porosity will allow good convection of air through the material, and may help to dissipate heat generated by illuminated LEDs. A person of skill in the art will know how to select a material on the basis of the performance characteristics desired.

Although FIGS. 1 and 2 show only one layer of fabric (i.e. the first sheet of fabric 22) positioned between the LEDs 20 and the finishing sheet of fabric 26, it should be appreciated that multiple sheets of fabric can be positioned between the LEDs 20 and the finishing sheet of fabric 26 without departing from the spirit of the invention. For example, the lighting device 10 may include two or more sheets of the same fabric positioned between the LEDs 20 and the finishing sheet of fabric 26. Or alternatively, the lighting device 10 may include two or more sheets of different fabrics positioned between the LEDs 20 and the finishing sheet of fabric 26. Furthermore, the lighting device 10 may include only the first sheet of fabric 22 covering the LEDs 20 and no finishing sheet of material 26 at all.

Positioned behind the plurality of LEDs 20 is the second sheet of fabric 24. As such, the plurality of LEDs 20 are sandwiched between the first sheet of fabric 22 and the second sheet of fabric 24. In a non-limiting embodiment, the second sheet of fabric 24 is formed of the same material as the first sheet of fabric 22. For example, both the first sheet of fabric 22 and the second sheet of fabric 24 can be formed of a fibrous material such as batting. It should be understood, however, that the second sheet of fabric can be formed of a fabric that is different from the first sheet of fabric 22, and can be formed of a fabric other than batting, without departing from the spirit of the invention.

For example, in a non-limiting embodiment that is not shown in the Figures, the second sheet of fabric 24 can be formed of a fabric that reflects light, such as a metal based material, a metal embedded material or a metallic material, such as aluminium. These materials can be completely reflective or partially reflective. In the embodiment where the second sheet of fabric is formed of a reflective material, instead of the light emitting portions 19 of the LEDs 20 facing the first sheet of fabric 22, the light emitting portions 19 of the LEDs 20 could face the second sheet of fabric 24, such that the light emitted by the LEDs 20 reflects off the second sheet of fabric 24 and shines through the front surface 30 of the lighting device 10. The reflection of the light off the second sheet of fabric 24 helps to diffuse the light being shone through the front surface 30 of the lighting device. In the case where the second sheet of fabric 24 is made of a completely reflective material, light will not shine through the rear surface 32 of the lighting device 10. However, in the case where the material is only partially reflective, some light is able to shine through the partially reflective material.

Positioned behind the second sheet of fabric 24, is a backing sheet of fabric 28. The backing sheet of fabric 28 can be formed of any suitable woven, or non-woven material. For example, the backing sheet of fabric 28 can be formed of the same material as the finishing sheet of fabric 26, such that the front surface 30 and the rear surface 32 have a uniform appearance. Alternatively, the backing sheet of fabric 28 can be formed of a fabric that is selected to provide performance characteristics to the lighting device 10. In a non-limiting example, the backing sheet of fabric 28 can be a UV resistant fabric or a flame-retardant fabric. It should be understood however that the other sheets of fabric used with the lighting device 10 can also provide performance characteristics to the lighting device 10, and that this function is not limited to the backing sheet of fabric 28. For example, in a preferred embodiment, all of the sheets of fabrics used for the lighting device 10 are flame retardant.

Although FIGS. 1 and 2 show only one layer of fabric (i.e. the second sheet of fabric 24) positioned between the LEDs 20 and the backing sheet of fabric 28, it should be appreciated that multiple sheets of fabric can be positioned between the LEDs 20 and the backing sheet of fabric 28 without departing from the spirit of the invention. For example, the lighting device 10 may include two or more sheets of the same fabric positioned between the LEDs 20 and the backing sheet of fabric 28. Or alternatively, the lighting device 10 may include two or more sheets of different fabrics positioned between the LEDs 20 and the backing sheet of fabric 28. In addition, it is possible that the lighting device 10 does not include a backing sheet of fabric 28 at all, and simply includes the second sheet of fabric 24.

In yet a further embodiment of the present invention, the lighting device 10 does not include either the second layer of fabric 24 or the backing layer of fabric 28. In such an embodiment, the lighting device 10 includes fabric layers covering only the light emitting portions 19 of the LEDs 20. Such a lighting device 10 might be beneficial in the case where the lighting device 10 is being mounted against a wall, or other surface, such that only the front surface 30 of the lighting device 10 will be seen.

Although FIGS. 1 and 2 show the lighting device 10 to be of a generally rectangular shape, it should be understood that lighting devices 10 of any shape and size are included within the scope of the present invention. In addition, the LEDs 20 can be positioned such that they are flat, in relation to the sheets of fabric used to form the lighting device 10, or alternatively, the LEDs 20 can be positioned at an angle in relation to the sheets of fabric. It should also be understood that any number and density of LEDs can be used, as will be described in more detail below.

It should also be appreciated that depending on the selection of fabrics used, and the number of sheets of fabric used, the lighting device 10 will vary in thickness. The fact that the lighting devices 10 in accordance with the present invention can be relatively thin enables them to be used in what have traditionally been considered to be hard-to-light places, such as behind furniture, and within cupboards, for example. In one non-limiting embodiment, the lighting device 10 will be relatively small, in order to form a type of "lighting patch" that can be used as a thin, flexible type of flashlight that is able to adjust its shape and configuration in order to be used in hard to light places. Such a "lighting patch" provides a wide throw of light that is often more useful than a focused beam of light provided by traditional flashlights.

It should also be appreciated that depending on the fabrics used, the lighting devices 10 in accordance with the present invention will be relatively flexible and soft.

The plurality of LEDs 20 used for the lighting device 10 of the present invention will now be described in more detail. The LEDs 20 can be of any color, shape, size or intensity without departing from the spirit of the invention. For example, the light emitting diodes 20 can be white LEDs, colored LEDs or RGB LEDs that are able to emit light of many different colors. Warm and cool white LEDs, colored LEDs and RGB LEDs are known in the art, and as such will not be described in more detail herein.

As shown in FIG. 2, each of the light emitting diodes 20 is electrically connected via wiring 23 to a transformer 39, and then to a power source connector 37. In order for the lighting device 10 to maintain its flexibility once assembled, it is preferable that the wiring 23 that electrically connects the LEDs 20 to each other, and/or to the transformer 39 and power source connector 37 is flexible. Wires suitable for this are known in the art, and as such will not be described in further detail herein. In a non-limiting embodiment, the wiring 23 is connected to the LEDs 20 via soldering at positive and negative connection points. However, in an alternative embodiment, the wiring can be connected to the light emitting diodes 20 via mechanical connectors. An advantage associated with mechanical connectors is that they provide a stronger, more durable connection with the light emitting diodes 20 since they are less susceptible to the stress of being moved about. Mechanical connectors for connecting wiring to light emitting diodes 20 are known in the art, and as such will not be described in more detail herein.

In the embodiment shown in FIGS. 1 and 2, the power source connector 37 is a plug for connecting to an electrical socket, such as a 110V/220V socket. It should be understood, however, that the power source connector 37 could also be a battery-connection unit for connecting to one or more batteries. In a non-limiting embodiment, the batteries could be embedded within the layers of fabric along with the LEDs 20. When the power source connector 37 is connected to a power source, such as an electrical socket or one or more batteries, current is provided to the LEDs 20 thereby enabling them to light up.

As shown in FIGS. 1 and 2, in the case where the power source connector 37 is a plug, the lighting device 10 includes a transformer 39 positioned between the plurality of LEDs 20 and the plug, such that the power received from the electrical socket can be converted into DC power. Different types of transformers can be used based on the power requirements of the light emitting diodes. The selection of a transformer suitable for the specific function required will be known by those skilled in the art.

In the embodiment shown in FIGS. 1 and 2, the plurality of light emitting diodes are electrically connected in series to the power source connector 37. It should be understood however that the plurality of light emitting diodes 20 can be wired to the power source connectors 37 in a variety of different manners without departing from the spirit of the invention. For example, a set of LEDs 20 could be connected in series, with two or more of such sets connected to the power source connector 37 in parallel. Different manners of electrically connecting the LEDs 20 to the power source connector 37/transformer 39 are known in the art, and as such will not be described in more detail herein. In a non-limiting embodiment of the present invention, the plurality of LEDs 20 are high-brightness LEDs. When high-brightness LEDs are used within the lighting device 10, the lighting device 10 can provide sufficient light for replacing conventional lighting devices such as overhead lights, and lamps. For the purposes of the present invention, the term "high-brightness LEDs" will refer to light emitting diodes that require above 50 mAmps of current per LED and/or that are capable of emitting at least 5 lumens.

The backing portion 21 of high-brightness LEDs tends to emit more heat than that of light emitting diodes that use less power. As such, in the case where the lighting device 10 uses high-brightness LEDs, it is desirable for the lighting device 10 to be mounted to a heat sink that helps to dissipate the heat generated by these high-brightness LEDs.

In the non-limiting embodiment shown in FIGS. 1 and 2, the lighting device 10 includes flexible heat sinks 34 that are adapted to be thermally connected to the backing portions 20 of the LEDs 20. In the embodiment shown, the heat sinks 34 are in the shape of elongated strips, which provide a larger surface area over which the heat generated by the LEDs 20 can be dissipated. This is particularly advantageous in the case where the LEDs 20 are sandwiched between numerous sheets of fabric that inhibit some of the dissipation of the heat generated by the LEDs 20.

In a non-limiting embodiment, the heat skinks 34 are formed of flexible strips of aluminium, however other metallic materials, such as copper, nickel, aluminium wool or any other metallic or non-metallic material suitable for dissipating heat could be used without departing from the spirit of the invention. In addition, the flexible metallic or non-metallic material can be layered, perforated or embossed or otherwise transformed to improve heat dissipation. Although the heat sinks 34 shown in FIGS. 1 and 2 are in the shape of elongated strips, heat sinks of any other shape and size can also be used without departing from the spirit of the invention. In addition, the heat sinks 34 can be formed of a combination of flexible and rigid materials, as will be described below.

In a non-limiting embodiment, the heat sinks 34 are formed of a reflective material, such that in addition to dissipating heat, the heat sinks 34 are able to reflect some of the light emitted by the LEDs 20. As such, the heat sinks 34 further help to diffuse and spread the light emitted by the LEDs 20.

Figure 3:
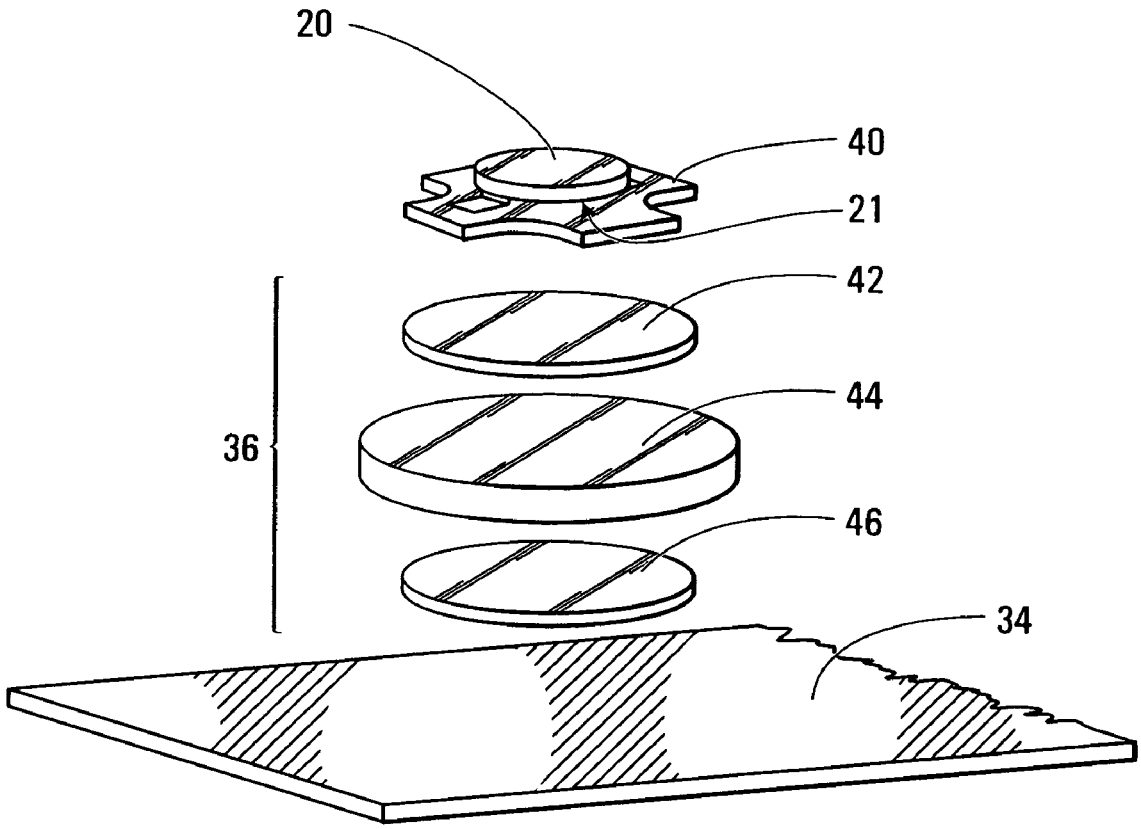
FIG. 3 shows an assembly for connecting a light emitting diode to a heat sink in accordance with a non-limiting embodiment of the present invention.

In the case where the plurality of LEDs 20 are not high-brightness LEDs, or are high brightness LEDs 20 that are under-driven such that they do not use enough power to generate sufficient heat to warrant a heat sink, the heat sinks 34 may be omitted from the lighting device 10. Likewise, the heat sinks 34 can be omitted in the case where the second sheet of fabric 24 or the backing sheet of fabric 28, is a heat dissipating surface, or in the case where the LED assembly is mounted directly to a heat dissipating surface, such as a metallic wall. Likewise the heat sinks 34 can be omitted in the situation where the heat is dissipated by other means Shown in FIG. 3 is a non-limiting example of an assembly 36 for mounting the LEDs 20 to the heat sinks 34. For the purposes of clarity, only one LED 20 has been shown in FIG. 3, however, it should be understood that the same assembly 36 can be used for the other LEDs 20 as well. As shown in FIG. 3, the LED 20 is mounted to a thermally conductive slug 40. In a non-limiting embodiment, the thermally conductive slug 40 is formed of aluminium, but slugs formed of other materials, such as copper, could also be used.

The first component of the assembly 36 is a piece of double-sided thermally conductive tape 42 for adhering the thermally conductive slug 40 to a thermally conductive interface pad 44. An example of a suitable double-sided thermally conductive tape is Thermally Conductive Adhesive Transfer Tape 9894FR provided by 3M. In addition, a non-limiting example of a thermally conductive interface pad is 3M Hyper-Soft Thermal Pad 5507S. The thermally conductive interface pad 44 is adhered to the flexible metallic heat sink 34 via a second piece of double-sided thermally conductive tape 46. It should be understood that the thermally conductive tape can be replaced by other attachment means, such as thermally conductive epoxy. In addition, it should be understood that the entire assembly 36 is only one possible embodiment, and that other manners of affixing the slug 40 to the heat sink 34 in thermally conductive communication can be used. For example, the strip of material that forms the heat sink 34 can be custom formed such that the slug 40 can be directly mounted thereto via a snap fit, for example, and hence remove the need for the intermediary tape and heat pad. As mentioned above, since the slug 40 is made of a rigid material, the heat sink 34 which is flexible, includes rigid portions thereon.

The assembly 36 formed of the thermally conductive interface pad 44 and the two pieces of double sided thermally conductive tape 42, 46 affixes the slug 40 to which the light emitting diode 20 is mounted, to the heat sink 34 in thermally conductive communication. In this manner, heat generated by the backing portion 21 of the light emitting diode 20 is transmitted through the slug 40 and then through the assembly 36 to the heat sink 34, which is then able to dissipate the heat. As such, the heat sinks 34 help to prevent the lighting device 10 from overheating during use, which could cause the light emitting diodes 20 to burn out.

Lighting devices in accordance with the present invention can be made in a variety of different manners. For example, in the embodiment shown in FIG. 1, the sheets of fabric 22, 24, 26, 28 are sewn together in order to form channels 50 between spaced apart longitudinal lines of sewing. The lighting device 10 shown in FIG. 1, includes three such channels 50, however, it should be understood that more or less channels could be included without departing from the spirit of the invention. Once the sheets of fabric 22, 24, 26, 28 have been sewn together in order to create the channels 50, strings of electrically connected LEDs 20 are fed into the channels, thereby creating lines of electrically connected LEDs 20 within the lighting device 10. The strings of electrically connected LEDs 20 can be fed into the channels 50 via a pipe or tube that feeds the strings of electrically connected LEDs 20 into the channels 50, for example. In a non-limiting embodiment, both ends of the channels 50 are open, such that the strings of electrically connected LEDs 20 can be both pushed and pulled into position. It should be understood that at the same time that the strings of electrically connected LEDs 20 are being fed into the channels 50, the heat sinks 34 to which the electrically connected LEDs are mounted, are also fed into the channels 50.

Once the strings of electrically connected LEDs 20, and optionally the heat sinks 34, have been fed within the channels 50, one or both ends of the channels through which the strings of electrically connected light emitting diodes 20 are fed can be closed in order to keep the light emitting diodes 20 positioned within the lighting device 10. In the embodiment shown in FIG. 1, the light emitting diodes 20 are fed into the channels 50 from the upper edge 52 of the lighting device 10. As such, the bottom edge can be sewed together, and the upper edge can also be closed permanently, such as with sewing or staples, for example. Alternatively, the upper edge 52 or the lower edge 52 can be closed in a re-openable fashion, such as with buttons or Velcro™, for example. In the case where the upper edge 52 is re-openable, the strings of electrically connected LEDs 20 can be removed from the channels 50 in the case where one of the LEDs 20 needs to be replaced, or in case the sheets of fabric need to be washed.

It should also be appreciated that the LEDs 20 and heat sinks 34 can be positioned between different sheets of fabrics within the lighting device 10, and are not restricted to being positioned between the same two sheets of fabrics.

In other words, there can be a "layering" of the LEDs 20, and in some cases the heat sinks 34 within the lighting device 10.

In an alternative embodiment, the electrically connected LEDs 20, and optionally the heat sinks 34, may be positioned between the sheets of fabric prior to the sheets of fabric being affixed together. For example, the sheets of fabric can be sewn together after the LEDs 20 have been positioned between the first sheet of fabric 22 and the second sheet of fabric 24. The sheets can be sewn together in a variety of different patterns. For example, in addition to having longitudinal seams down the length of the lighting device 10, horizontal seams could also be included, wherein the horizontal seams are sewn through the flexible metallic heat sinks 34, and over the wiring 23. In addition, the sheets can be sewn together using a continuous, possibly curved, seam. In yet another embodiment, only the edges of the lighting device 10 could be sealed together, such that the sheets of fabric are not sealed together at any location within the edges of the lighting device 10. Such an embodiment might require that the strings of electrically connected LEDs 20 are attached via sewing, stapling, or adhesive to the first sheet of fabric 22 or the second sheet of fabric 24.

In alternative examples of implementation, the sheets of fabric can be affixed together using techniques such as adhesive, thermal bonding, vacuum sealing, spot tacking or stapling, for example. In fact, any technique known in the art for joining sheets of fabric together could be used without departing from the spirit of the invention. As will be described in more detail below, in some scenarios, the sheets of fabric will not be joined together at all.

Although FIGS. 1 and 2 show the plurality of light emitting diodes 20 positioned in rows, it should be understood that the LEDs 20 can be positioned between the sheets of fabric in a variety of different patterns or configurations. Similarly, the light emitting diodes 20 can be positioned in any desired density. In this manner, the more light that is desired from the lighting device 10, the more light emitting diodes 20 can be positioned between the sheets of fabric. The density of light emitting diodes 20 within a lighting device 10 can also vary, such that the density within the lighting device 10 is non-uniform. For example, the light emitting diodes 20 can increase in density towards the centre of the lighting device 10, or can increase in density from one side of the lighting device to the other, or from the top of the lighting device 10 to the bottom. It should be appreciated that the light emitting diodes 20 can be positioned within the lighting device 10 in any other configuration without departing from the spirit of the invention.

Once the lighting device 10 has been assembled such that the plurality of light emitting diodes 20 are covered by one or more sheets of fabric, the lighting device 10 is connected to a power source via the power source connector 37. In the case where the power source connector 37 is a plug, the plug is inserted into an electrical socket for providing a flow of electrical current to the light emitting diodes 20. In the case where the power source connector 37 is a battery connection unit, the battery connection unit is connected to one or more batteries.

Figure 4:
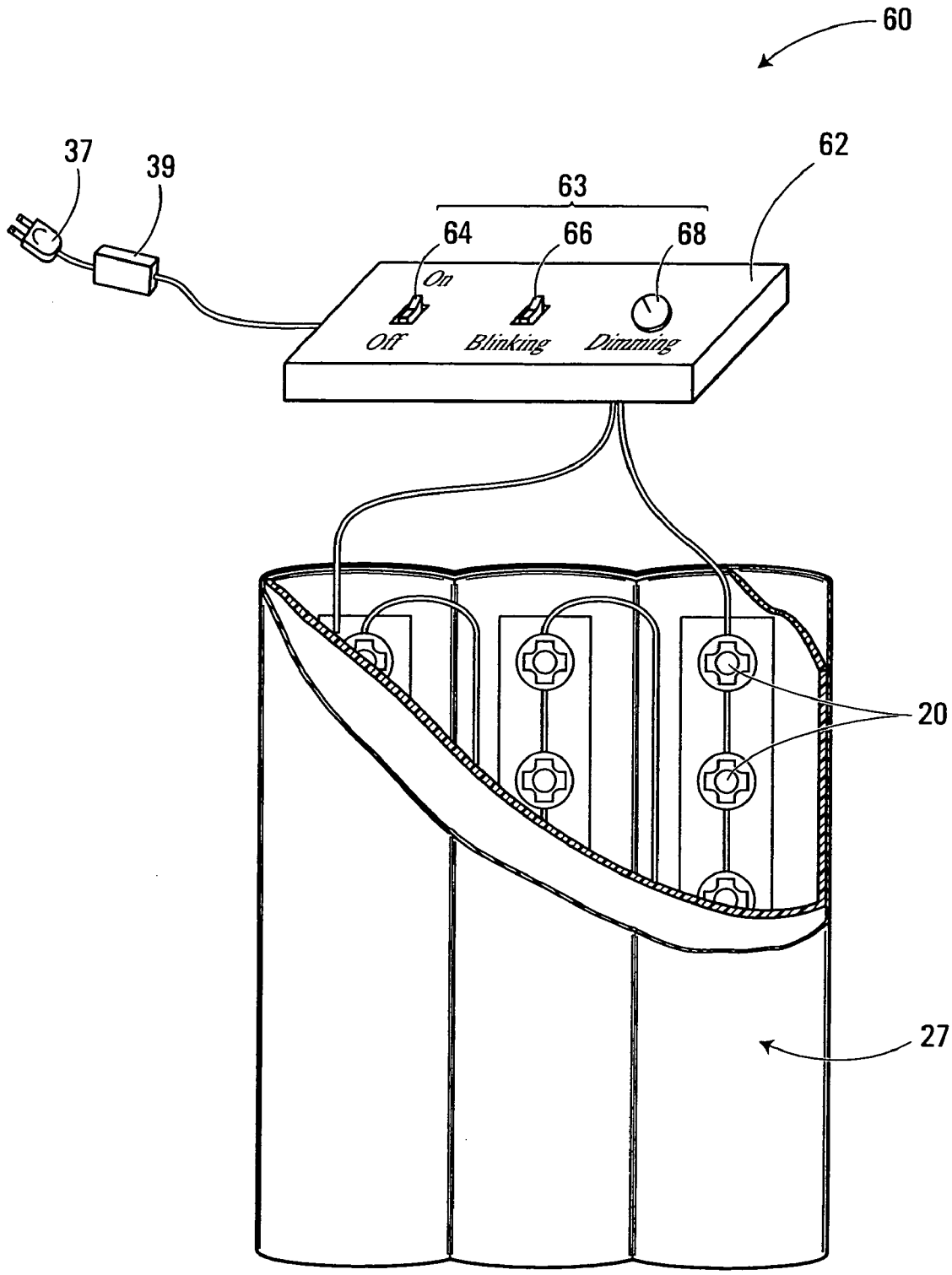
FIG. 4 shows a front perspective view of a lighting device in accordance with a second non-limiting embodiment of the present invention.

In a non-limiting embodiment, the lighting device 10 can be a modular component that is able to be connected to other lighting devices 10. For example, two or more lighting devices 10 can be joined together via velcro™M, poppers, buttons, zips, sewing, thermal bonding or any other fastening means known in the art, in order to form a larger lighting device. In order to electrically connect the light emitting diodes 20 of one lighting device to those of another lighting device, each of the lighting devices 10 could include a male plug, as shown in FIG. 4, and a female plug (not shown). In this manner, by connecting the male plug of one of the lighting devices with the female plug of the other lighting device, the lighting devices 10 can be electrically connected. Once connected together, the connection of only one male plug into an electrical wall socket will cause the plurality of light emitting diodes 20 in both lighting devices 10 to light up. It should be understood that in the case where two or more lighting devices are joined together in this manner, the lighting device 10 may require local power management devices for managing the power supplied to groups of one or more LEDs 20 that have been strung together. The modularity of the lighting devices 10 enables the size of the lighting device to be customised in order to be suitable for different applications Shown in FIG. 4, is a lighting device 60 in accordance with an alternative embodiment of the present invention. The lighting device 60 comprises a plurality of light emitting diodes 20 covered by at least one sheet of fabric 27, as described above with respect to FIGS. 1 and 2, and a lighting control unit 62 for controlling various settings of the light emitting diodes 20. The lighting control unit 62 is operative for controlling various settings of the light emitting diodes such as on/off, blinking, dimming, pattern changes, color changes, and video-screen like effects. In the case where RGB LEDs are used, the lighting control unit 62 can also control the brightness and color of the LEDs for creating lighting effects and for displaying variable color patterns and images.

In the embodiment shown, the lighting control unit 62 includes three user operable control inputs 63; namely an activation switch 64 for turning the LEDs 20 on and off, a blinking switch 66 for causing the LEDs 20 to blink and a dimmer knob 68 for causing the LEDs 20 to dim. It should be understood that the lighting control unit 62 could include more or less user operable control inputs 63, without departing from the spirit of the invention. For example, the lighting control unit 62 might include only the activation switch 64. Alternatively, the lighting control unit 62 might include additional user operable control inputs 63 such as for enabling a user to control the color of light emitted from the LEDs 20, in the case where the LEDs are RGB LEDs.

It should also be appreciated that depending on how the light emitting diodes are wired to the lighting control unit 62, one or more of the light emitting diodes 20 can be controlled independently from the other light emitting diodes 20. For example, it is possible that a set of one or more electrically connected light emitting diodes 20 is dimmed independently of the other light emitting diodes 20. In such a scenario, the lighting control unit 62 may include multiple different dimming knobs for controlling the dimming of a respective set of light emitting diodes 20.

In addition, the lighting control unit 62 may be programmable such as to cause the light emitting diodes to light up in accordance with a predetermined sequence or pattern. For example, the lighting control unit 62 could control the activation of the light emitting diodes 20 such that horizontal rows of the light emitting diodes 20 turn on and off in sequence from top to bottom. Alternatively, the lighting control unit 62 could control the activation of the light emitting diodes 20, such that they turn on and off in order to convey an image such as a flower blooming, or a fireworks display. Although the lighting control unit 62 has been shown in FIG. 4 as a control box comprising user operable control inputs 63, it should be understood that in an alternative embodiment, the lighting control unit 62 can be in the form of a computer. For example, in the case where the lighting control unit 62 is operative for controlling the LEDs 20 in order to create video-screen like effects, the lighting control unit 62 will most likely be in the form of a more sophisticated computing unit. Control units suitable for controlling the plurality of light emitting diodes in the manner described above are known in the art, and as such will not be described in more detail herein. As will be described below, in order to achieve many of the lighting effects described above, the LEDs 20 will be mounted to one or more circuit boards that have various components for assisting the controller in the control of the LEDs 20.

In a further embodiment of the present invention, the lighting control unit 62 can be in communication with environmental sensors that detect various conditions of the environment surrounding the lighting device 60. In this manner the lighting control unit 62 can be operative for providing environmentally adaptive control of the light emitting diodes 20. An example of such an environmental sensor is a light sensor that enables the lighting control unit 62 to turn the light emitting diodes 20 on or off, or dim the lights, depending on the amount of light detected in the surrounding environment. A further example is a motion sensor that enables the lighting control unit 62 to turn the light emitting diodes 20 on or off in response to movement detected within the environment.

In addition to the lighting control unit 62, in a non-limiting embodiment of the present invention, each of the light emitting diodes 20 is mounted directly to a printed circuit board that comprises components such as integrated circuits and/or microprocessors that are able to control the various settings of the light emitting diodes 20. In a non-limiting embodiment, the circuit boards can be flexible components, in order to maintain the overall flexibility of the lighting device 60.

The components contained on the printed circuit boards can be adapted for controlling all of settings described above, such as on/off, blinking, dimming etc. . . . , as well as for providing environmentally adaptive control of the light emitting diodes 20. Alternatively, the environmental sensors can be embedded separately within the fabric along with the LEDs 20. The sensors are then able to communicate with the lighting control unit 62, which is operative to control the LEDs via the circuit on the basis of the signals received from the environmental sensors.

In addition, the printed circuit boards can include power management components that are able to control the amount of power provided to each LED 20. As such, regardless of the amount of current supplied to the LEDs, the power management components on the printed circuit boards ensure that the appropriate amount of power is available to each LED 20. This greatly simplifies the manner in which the LEDs 20 are wired together.

Figure 5:
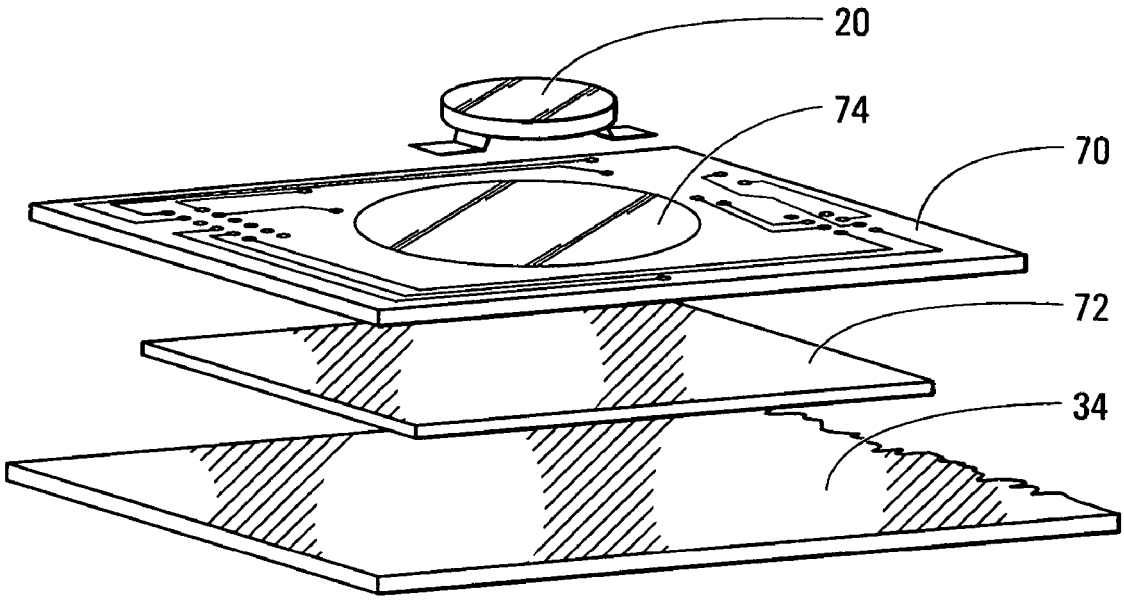
FIG. 5 shows an assembly for connecting a light emitting diode to a heat sink in accordance with a second non-limiting embodiment of the present invention.

In accordance with a non-limiting embodiment of the present invention, FIG. 5 shows a light emitting diode 20 mounted to an individual printed circuit board 70. For the purposes of clarity, only one light emitting diode 20 has been shown in FIG. 5. The printed circuit board 70 includes aluminium, or other thermally conductive core 74, to which the light emitting diode 20 is mounted via soldering, thermal and/or conductive epoxy or via mechanical connectors. Once mounted to the printed circuit board 70, the combination of the printed circuit board 70 and the light emitting diode 20 is electrically connected to a power supply connector (not shown) via wiring that connects to the LEDs at their positive and negative connection nodes. In a similar manner, the circuit boards are connected to the lighting control unit 62 for receiving control signals for controlling the functions of the LEDs 20. The manner in which the circuit boards and components mounted thereto are connected to a controller, such as the lighting control unit 62, are known in the art and as such will not be described in more detail herein.

In operation, the components contained on the printed circuit board 70 receive power and control signals from the lighting control unit 62. Upon receipt of the power and the control signals, the components contained on the printed circuit board 70 are operative for controlling the settings of the light emitting diode 20. As mentioned above, the components contained on the printed circuit board 70 are operative to control the on/off, blinking, dimming and color change of the light emitting diodes 20 on the basis of signals received from the lighting control unit 62. Likewise, the components contained on the printed circuit boards 70 can cause the light emitting diodes 20 to light up in accordance with a predetermined sequence or pattern, as described above, such that the combination of the light emitting diodes 20 is able to convey a pattern, image or video screen like effects. The components on the circuit board can be pre-programmed in order to achieve these effects, or alternatively they can control the light emitting diodes 20 in this manner on the basis of signals received from the lighting control unit 62, or sensors.

As shown in FIG. 5, the printed circuit boards 70 can be mounted to the heat sinks 34 via a piece of double sided thermally conductive tape 72. As mentioned above, thermally conductive epoxy could also be used. In yet another alternative embodiment, the printed circuit boards 70 can be mounted to the heat sinks 34 via mechanical connectors. As such, the printed circuit board 70 could be able to be snapped into the heat sink 34. As mentioned above, once the light emitting diode 20 is in thermally conductive communication with the heat sink 34, the heat sink 34 helps to dissipate any heat that is generated. In an alternative embodiment, the combination of the light emitting diode 20 and the printed circuit board 70 is not mounted to a heat sink.

In the same manner as described above with respect to the lighting device 10, the lighting device 60 can be a modular component that can be joined to other lighting devices. In the case where one or more additional lighting devices is attached to lighting device 60, the lighting control unit 62 can be programmed such that it is able to control the light emitting diodes 20 of all of the lighting devices that are connected together. In this manner, the lighting control unit 62 can control the LEDs 20 of all the lighting devices such that the plurality of LEDs 20 operate in accordance with a uniform behaviour. For example, the lighting control unit 62 of one of the lighting devices 60 can be programmed to be a master control unit, and the lighting control units 62 of the other lighting devices 60 can be programmed to be follower control units, such that when the multiple lighting devices 60 are connected together, the lighting devices 60 are programmed to all be controlled by the master control unit. Additionally, the controlling duties of the lighting control unit 62 can be shared by components on one or more of the printed circuits boards 70 associated with individual LEDs 20, possibly making the lighting control unit 62 unnecessary. The ability to share controlling duties may also be executed in a modular way, such that as new lighting units 60 are added, their controlling units 62 or controlling circuitry can be detected and included such that they contribute to the overall controlling duties.

The lighting devices 10 and 60 provide many of the same properties as a sheet of fabric. For example, the lighting devices 10, 60 can be soft, and pleasant to the touch. These qualities, in addition to the quality of illumination given off by the lighting devices 10, 60, enable the lighting devices 10, 60 to be used in a variety of different applications. For example, the lighting devices 10 and 60 can be used for upholstering, inclusion within clothing, hanging devices, free standing devices, etc. . . . Some non-limiting examples of applications for the lighting devices 10 and 60 in accordance with the present invention will be described in more detail below.

Figure 6:
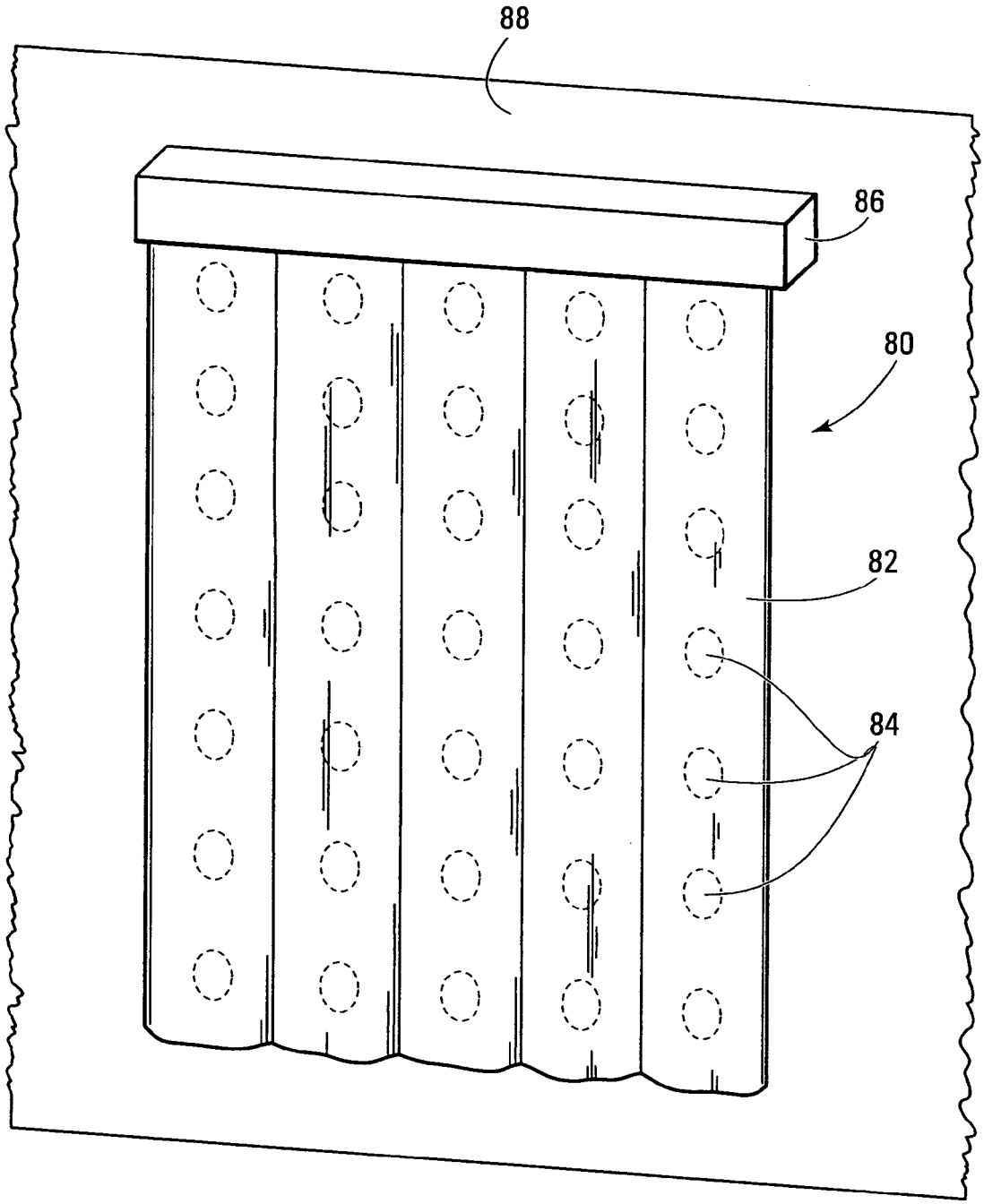
FIG. 6 shows a lighting device in accordance with a non-limiting embodiment of the present invention in the form of a hanging illumination sheet.

For example, shown in FIG. 6 is a lighting device as described above with respect to FIGS. 1 through 5, that is in the form of a hanging illumination sheet 80. The hanging illumination sheet 80 includes one or more sheets of fabric 82, as described with respect to FIGS. 1 and 2, a plurality of light emitting diodes 84, which have been shown in dotted lines for the purpose of clarity, and a mounting structure 86. The mounting structure 86 is operative for mounting the one or more sheets of fabric 82 and the plurality of light emitting diodes 84 to a supporting structure 88, such as a wall or ceiling. The mounting structure 86 can also be used to conceal the wiring, transformers and any lighting control unit that is part of the hanging illumination sheet 80. It should be understood that the mounting structure 86 could also be in the form of a rod/tube or frame. It can also be attached on any or all of the sides of the sheet of fabric 82.

In the case where the light emitting diodes 84 are high-brightness light emitting diodes 84, the hanging illumination sheet 80 can be of a sufficient size, and emit sufficient light to be the primary source of illumination for a room. As such, instead of having to rely on overhead lighting, or floor lamps, the hanging illumination sheet 80 can be the primary source of illumination. The hanging illumination sheet 80 can be hung as a wall hanging within a room or entryway, as a partition between two rooms, or alternatively, the hanging illumination sheet 80 can be hung as a curtain. In the case where the hanging illumination sheet 80 is hung as a curtain, during the day when a room is illuminated by natural light, the hanging illumination sheet 80 can be pulled back away from the window. Then at night, when there is no more natural illumination, the hanging illumination sheet 80 can be drawn over the window and turned on. As such, the light that comes from the hanging illumination sheet 82 at night comes from the same part of the room as the natural light that comes in through the window during the day.

In an alternative embodiment that is not shown in the Figures, the hanging illumination sheet 80 can be mounted over a sky light. In such an embodiment, the mounting structure 86 would need to secure the hanging illumination sheet 80 over a skylight, and as such might need to be attached to multiple sides of the illumination hanging sheet 80. Once assembled to cover the sky light, during the day natural light can penetrate through the hanging illumination sheet 80 in order to provide light, and during the night the hanging illumination sheet 80 can be turned on such that the illumination from the hanging illumination sheet 80 comes from the same part of the room as the natural light during the day. It should be understood that in such an embodiment, the fabrics used to form the lighting device should be either transparent or sufficiently translucent to be able to allow natural light to pass therethrough.

Figure 7:
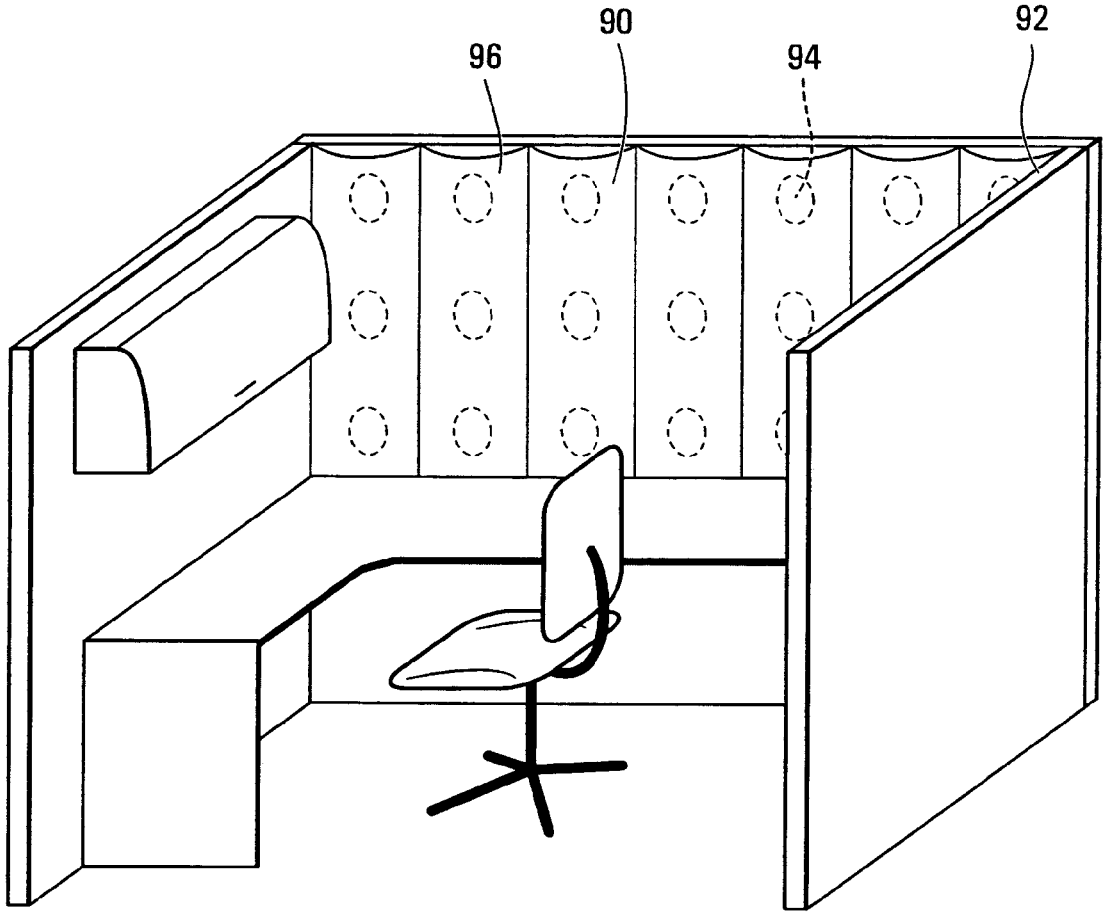
FIG. 7 shows a lighting device in accordance with the present invention in the form of a portion of a cubicle partition.

Shown in FIG. 7 is a lighting device 90 that forms a portion of an article of furniture. In the embodiment shown, the lighting device 90 forms a portion of a cubicle partition 92. In this embodiment, the lighting device 90 includes a plurality of light emitting diodes 94 that have been shown in dotted lines for the purposes of clarity, and at least one sheet of fabric 96 that is mounted to a frame of the cubicle partition 92. Although the lighting device 90 is shown as a portion of a cubicle partition, it should be understood that the lighting device 90 could be included as part of a book shelf, within a cabinet, as part of a chair or desk, or as part of any other article of furniture.

Figure 8:
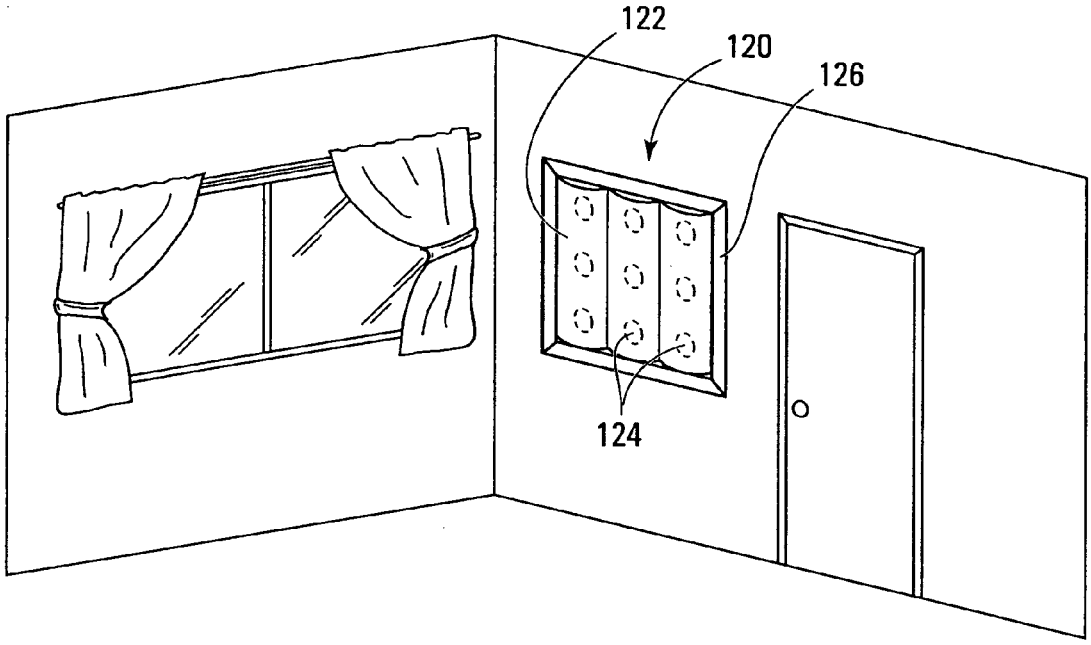
FIG. 8 shows a lighting device in accordance with the present invention in the form of a framed piece of material covering one or more LEDs.

Shown in FIG. 8 is a lighting device as described above with respect to FIGS. 1 through 5, in the form of a framed lighting source 120. The framed lighting source 120 includes one or more sheets of fabric 122, as described with respect to FIGS. 1 and 2, a plurality of light emitting diodes 124, which have been shown in dotted lines for the purpose of clarity, and a frame 126. The framed lighting source 120 can be mounted to any surface such as a wall, a ceiling, a counter, a door, etc. . . . Frame 126 is operative for keeping the sheets of fabric 122 and the plurality of light emitting diodes 124 together such that they can be mounted in a desired location. In this embodiment, it is possible that the sheets of fabric 122 are not secured together prior to being attached to the frame 126.

Figure 9:
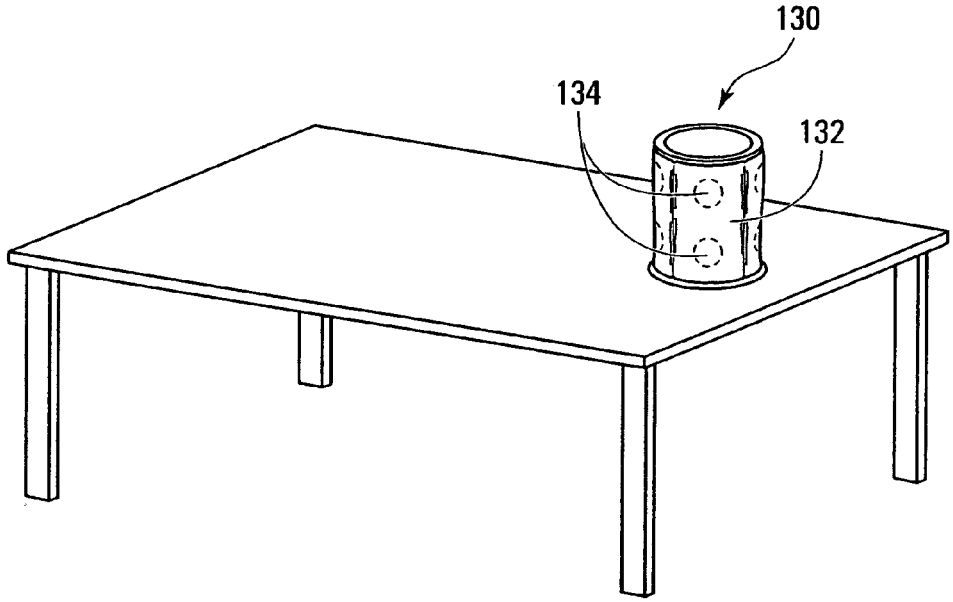
FIG. 9 shows a lighting device in accordance with the present invention that has been formed into a three dimensional shape that is able to stand alone.

Shown in FIG. 9 is a lighting device as described above with respect to FIGS. 1 through 5, in the form of a stand-alone lighting source 130. The stand-alone lighting source 130 includes one or more sheets of fabric 132, as described with respect to FIGS. 1 and 2, and a plurality of light emitting diodes 134, which have been shown in dotted lines for the purpose of clarity. The stand alone lighting source 132 is formed of sheets of fabric, and/or heat sinks (not shown), that are of sufficient rigidity to maintain a three dimensional shape, such as the tube shown in FIG. 9. Although still flexible, the stand-alone lighting source 130 has sufficient rigidity to maintain a three dimensional shape without too much deformation. Although a tube 130 has been shown for the purposes of FIG. 9, other shapes such as a cube, or an arch could be formed without departing from the spirit of the invention.

In a non-limiting embodiment, in addition to the electrically connected LEDs 134 and heat sinks (not shown) the stand-alone lighting source 130 may include reinforcing strips of material, such as metal rods cables or wires, that are able to help the stand-alone lighting source 130 maintain its three dimensional shape.

The stand-alone lighting source 130 of FIG. 9 has been shown as being positioned on a table 136 such that it acts as a type of table lamp. It should be understood however, that the stand-alone lighting sources could also form a floor lamp and decorative shelf lighting, among other possibilities.

Figure 10:
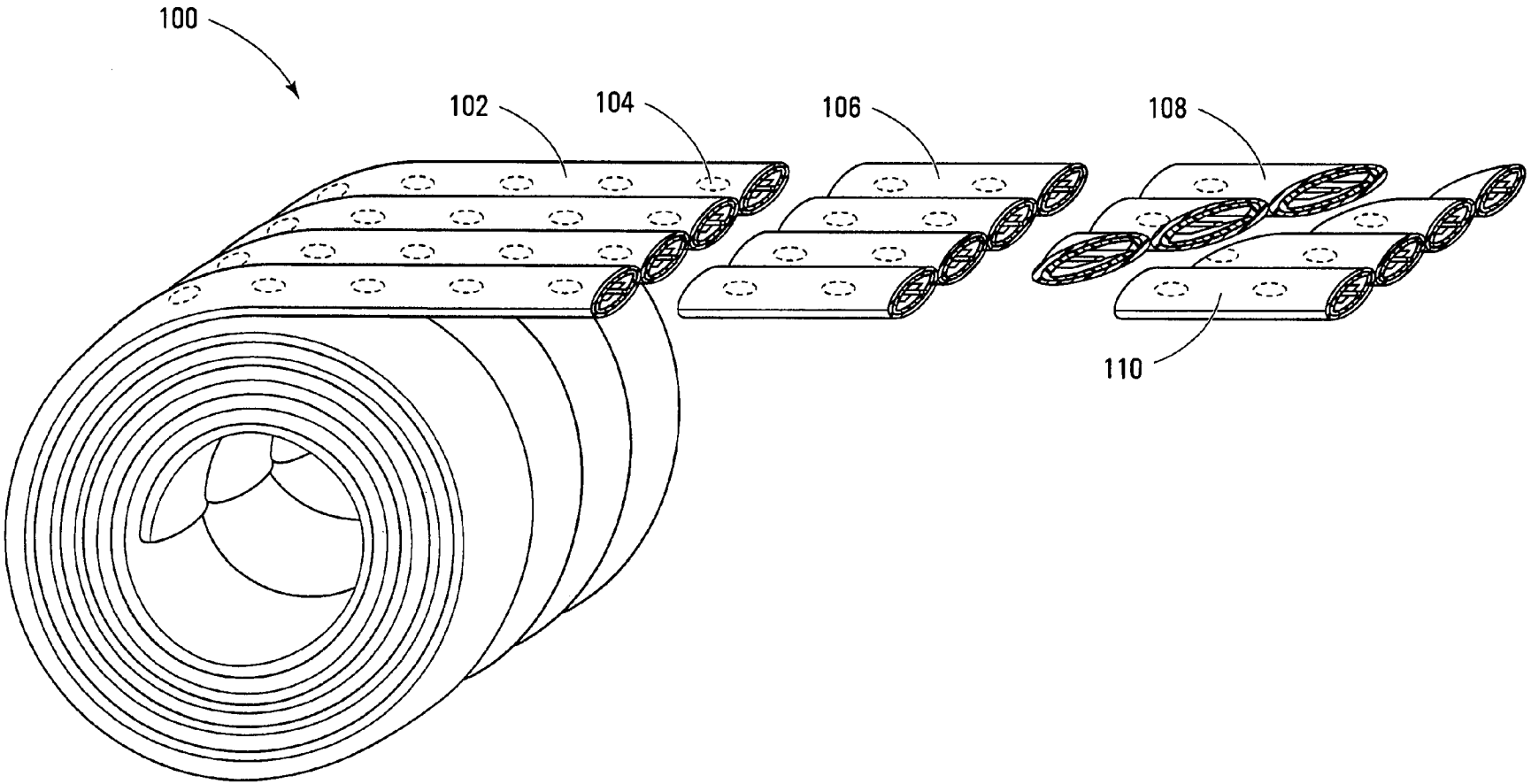
FIG. 10 shows a lighting device in accordance with the present invention in the form of a roll of material from which many other lighting devices in accordance with the present invention can be made.

Shown in FIG. 10 is a roll 100 of material from which lighting devices in accordance with the present invention can be made. As shown, the roll 100 includes at least one sheet of fabric 102 with a plurality of light emitting diodes 104 positioned therein. The roll 100 can be cut into portions of any size and shape, such as portions 106, 108 and 110 in order to create lighting devices in those shapes. In order to be able to cut the roll 100 into a variety of different shapes, the roll 100 can include redundant wiring between the plurality of light emitting diodes 104 such that regardless of the shape and size of the portions cut from the roll 100, the LEDs 104 within that portion will be electrically connected together. In this manner, in order to create the final lighting device, the ends of the cut portion are sealed, and a power source connector, such as a plug (not shown) is electrically connected to the plurality of electrically connected LEDs 104. In addition, a lighting control unit can be connected to the plurality of light emitting diodes 104, if so desired.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A lighting device comprising:

a first sheet of fibrous material, said first sheet of fibrous material being covered by a finishing sheet of fabric;

a backing sheet of flexible material connected to at least one of said first sheet of fibrous material and said finishing sheet of fabric;

a plurality of light emitting diodes adapted for being electrically connected to a power source, said plurality of light emitting diodes being high-brightness light emitting diodes, at least some of said high-brightness light emitting diodes being mounted to a flexible heat sink, said plurality of light emitting diodes being positioned between said first sheet of fibrous material and said backing sheet such that light emitted from said plurality of light emitting diodes shines through said first sheet of fibrous material and said finishing sheet of fabric.

2. A lighting device as defined in claim 1, wherein said plurality of light emitting diodes are colored light emitting diodes.

3. A lighting device as defined in claim 1, wherein said plurality of light emitting diodes are RGB light emitting diodes.

4. A lighting device as defined in claim 1, wherein said sheet of fibrous material is a flexible non-woven batting fabric.

5. A lighting device as defined in claim 1, wherein said flexible heat sink includes a metallic material.

6. A lighting device as defined in claim 5, wherein said flexible heat sink includes a strip of aluminium.

7. A lighting device as defined in claim 1, wherein said flexible heat sink is formed of a light reflecting material.

8. A lighting device as defined in claim 1, wherein said plurality of light emitting diodes are electrically connected to at least one printed circuit board.

9. A lighting device as defined in claim 1, further comprising a lighting control unit for controlling various settings of at least one light emitting diode in said plurality of light emitting diodes.

10. A lighting device as defined in claim 9, wherein said various settings are selected from the group consisting of an on/off setting, a blinking setting, a dimming setting, a color change setting and a pattern change setting.

11. A lighting device as defined in claim 9, wherein said lighting control unit includes environmental sensors, said lighting control unit being operative for controlling at least one of said light emitting diodes in said plurality of light emitting diodes on the basis of readings from said environmental sensors.

12. A lighting device as defined in claim 11, wherein said lighting control unit includes a light sensor.

13. A lighting device as defined in claim 1, wherein said plurality of light emitting diodes are electrically connected to a plug.

14. A lighting device as defined in claim 1, wherein said plurality of light emitting diodes are electrically connected to a battery connection unit.

15. A lighting device as defined in claim 1, wherein said plurality of light emitting diodes are positioned between said first sheet of fibrous material and said backing sheet in a non-uniform density.

16. A lighting device comprising:

a first sheet of fabric;

a second sheet of fabric connected to said first sheet of fabric;

a plurality of light emitting diodes positioned between said first sheet of fabric and said second sheet of fabric, said plurality of light emitting diodes being electrically connected to a power source connector;

at least one flexible heat sink in thermally conductive communication with at least two of said plurality of light emitting diodes, said at least one flexible heat sink being a flexible piece of heat conducting material that spans between at least two of said plurality of light emitting diodes.

17. A lighting device as defined in claim 16, wherein said plurality of light emitting diodes are high-brightness light emitting diodes.

18. A lighting device as defined in claim 16, wherein said plurality of light emitting diodes are colored light emitting diodes.

19. A lighting device as defined in claim 16, wherein said plurality of light emitting diodes are RGB light emitting diodes.

20. A lighting device as defined in claim 16, wherein said first sheet of fabric is a flexible non-woven batting fabric, and said second sheet of fabric is a flexible non-woven batting fabric.

21. A lighting device as defined in claim 20, wherein said first sheet of fabric is covered by at least one finishing sheet of fabric, such that light emitted from said plurality of light emitting diodes shines through said first sheet of fabric and said at least one finishing sheet of fabric.

22. A lighting device as defined in claim 16, wherein said heat sink includes a flexible metallic material.

23. A lighting device as defined in claim 16, wherein each light emitting diode of said plurality of light emitting diodes is electrically connected to a printed circuit board.

24. A lighting device as defined in claim 23, further comprising a lighting control unit for controlling various settings of at least one light emitting diode in said plurality of light emitting diodes.

25. A lighting device as defined in claim 24, wherein said lighting control unit includes environmental sensors, said lighting control unit being operative for controlling said plurality of light emitting diodes on the basis of readings from said environmental sensors.

26. A lighting device as defined in claim 16, wherein said power source connector is a plug.

27. A lighting device as defined in claim 16, wherein said power source connector is a battery connection unit.

28. An illuminating device, comprising:

a plurality of light emitting diodes electrically connected to one another, and adapted for being electrically connected to a power source;

at least one sheet of fibrous material covered by a finishing sheet of fabric, and a backing sheet of flexible material, said plurality of light emitting diodes being positioned between said at least one sheet of fibrous material and said backing sheet of flexible material such that light emitted from said plurality of light emitting diodes shines through said sheet of fibrous material and said finishing sheet of fabric.

a wall mounting structure connected to said at least one sheet of fibrous material for mounting said plurality of light emitting diodes and said sheet of fibrous material to at least one of a wall and a ceiling of a room, such that light that shines through said at least one sheet of fibrous material and said finishing sheet of fabric provides illumination to the room.

29. A lighting device comprising:

a plurality of light emitting diodes electrically connected to one another and adapted for being electrically connected to a power source;

at least one sheet of fibrous material covered by a finishing sheet of fabric and a backing sheet of flexible material, said plurality of light emitting diodes being positioned between said sheet of fibrous material and said backing sheet of flexible material such that light emitted from said plurality of light emitting diodes shines through said at least one sheet of fibrous material and said finishing sheet of fabric;

a lighting control unit in electrical communication with said plurality of light emitting diodes, said lighting control unit being operative for controlling at least one setting selected from the list of settings consisting of a blinking setting, a dimming setting, a color change setting and a pattern change setting.

30. A lighting device as defined in claim 1, wherein said plurality of light emitting diodes are arranged in a matrix having at least two rows, and at least two columns.

31. A lighting device comprising:

a first sheet of fibrous material, said first sheet of fibrous material being covered by a finishing sheet of fabric;

a backing sheet of flexible material connected to at least one of said first sheet of fibrous material and said finishing sheet of fabric;

a plurality of light emitting diodes adapted for being electrically connected to a power source, said plurality of light emitting diodes being positioned between said first sheet of fibrous material and said backing sheet such that light emitted from said plurality of light emitting diodes shines through said first sheet of fibrous material and said finishing sheet of fabric;

a lighting control unit for controlling various settings of at least one light emitting diode in said plurality of light emitting diodes, said lighting control unit including at least one environmental sensor, said lighting control unit being operative for controlling at least one of said light emitting diodes in said plurality of light emitting diodes on the basis of readings from said at least one environmental sensor.

32. An illuminating device as defined in claim 28, wherein said plurality of light emitting diodes are colored light emitting diodes.

33. An illuminating device as defined in claim 28, wherein said sheet of fibrous material is a flexible non-woven batting fabric.

34. An illuminating device as defined in claim 28, wherein at least some of said plurality of light emitting diodes are mounted to a flexible heat sink.

35. An illuminating device as defined in claim 34, wherein said flexible heat sink includes a metallic material.

36. An illuminating device as defined in claim 35, wherein said flexible heat sink includes a strip of aluminium.

37. An illuminating device as defined in claim 28, wherein said plurality of light emitting diodes are electrically connected to at least one printed circuit board.

38. An illuminating device as defined in claim 37, further comprising a lighting control unit for controlling various settings of at least one light emitting diode in said plurality of light emitting diodes.

39. An illuminating device as defined in claim 28, wherein said plurality of light emitting diodes are positioned between said sheet of fibrous material and said backing sheet in accordance with a non-uniform density.

40. A lighting device as defined in claim 29, wherein said plurality of light emitting diodes are colored light emitting diodes.

41. A lighting device as defined in claim 29, wherein said at least one sheet of fibrous material is a flexible non-woven batting fabric.

42. A lighting device as defined in claim 29, wherein at least some of said plurality of light emitting diodes are mounted to a flexible heat sink.

43. A lighting device as defined in claim 42, wherein said flexible heat sink includes a metallic material.

44. A lighting device as defined in claim 29, wherein said plurality of light emitting diodes are electrically connected to at least one printed circuit board.

45. A lighting device as defined in claim 29, wherein said lighting control unit includes environmental sensors, said lighting control unit being operative for controlling at least one of said light emitting diodes in said plurality of light emitting diodes on the basis of readings from said environmental sensors.

* * * * *